US010080392B2

(12) United States Patent
McCully

(10) Patent No.: US 10,080,392 B2
(45) Date of Patent: Sep. 25, 2018

(54) HAND WRAP AND METHOD

(71) Applicant: Justin McCully, Orange, CA (US)

(72) Inventor: Justin McCully, Orange, CA (US)

( * ) Notice: Subject to any disclaimer, the term of this patent is extended or adjusted under 35 U.S.C. 154(b) by 757 days.

(21) Appl. No.: 13/944,659

(22) Filed: Jul. 17, 2013

(65) Prior Publication Data

US 2015/0052655 A1 Feb. 26, 2015

(51) Int. Cl.
*A41D 13/08* (2006.01)
*A63B 71/14* (2006.01)

(52) U.S. Cl.
CPC ..... *A41D 13/084* (2013.01); *A63B 71/145* (2013.01); *A63B 2209/10* (2013.01)

(58) Field of Classification Search
CPC ..... A63B 71/143; A63B 2209/10; A63B 2102/14; A63B 2102/24; A63B 2071/125; A63B 71/141; A63B 2209/00; A63B 71/12; A63B 71/1225; A63B 71/14; A63B 2069/0008; A63B 2102/22; A63B 71/145; A63B 71/146; A41D 19/01529; A41D 13/0518; A41D 13/0512; A41D 13/06; A41D 13/015; A41D 13/065; A41D 13/08; A41D 1/06; A41D 20/00; A41D 13/0005; A41D 13/0007; A41D 13/0017; A41D 13/0153; A41D 13/043; A41D 13/0543; A61L 2202/122; A61L 2202/24; A61L 2/208; A61L 2202/13; A61L 2202/14; A61L 2/20; A61L 2/202; A61L 2/16; A61L 2202/11
USPC ..... 2/16, 20, 18
See application file for complete search history.

(56) References Cited

U.S. PATENT DOCUMENTS

| | | | | |
|---|---|---|---|---|
| 4,287,609 | A * | 9/1981 | Amadeo | A41D 13/081 2/16 |
| 5,592,694 | A * | 1/1997 | Yewer, Jr. | A41D 13/081 2/161.1 |
| 5,781,928 | A | 7/1998 | Avila | |
| 6,013,044 | A * | 1/2000 | Estwanik | A41D 19/01582 2/161.1 |
| 6,093,165 | A * | 7/2000 | Estwanik | A41D 19/01582 2/161.7 |
| 6,119,267 | A * | 9/2000 | Pozzi | A41D 13/088 2/161.1 |
| 2011/0283432 | A1* | 11/2011 | Best | A41D 13/088 2/16 |
| 2013/0145512 | A1* | 6/2013 | Niemeyer | A41D 20/00 2/16 |

* cited by examiner

*Primary Examiner* — Alissa L Hoey
*Assistant Examiner* — Catherine M Ferreira
(74) *Attorney, Agent, or Firm* — Eric Karich; Karich & Associates

(57) ABSTRACT

A hand wrap includes a knuckle cover sheet, and an elongate wrap body that is adapted to be wrapped around a hand and a wrist of a user. An attachment strap connects the knuckle cover sheet with a proximal end of the elongate wrap body. A fastening mechanism fastens a distal end of the elongate wrap body to itself to secure the hand wrap in place around the hand and wrist of the user while in use. The invention further includes a method of use of the hand wrap to wrap the hand and the wrist of the user.

4 Claims, 6 Drawing Sheets

HAND WRAP AND METHOD

BACKGROUND OF THE INVENTION

Field of the Invention

This invention relates generally to hand or wrist protection, and more particularly to hand wraps of the sort utilized by boxers, MMA fighters, and other pugilists for hand and wrist protection during the execution of the sport.

Description of Related Art

It is common for martial fighters to wrap their hands and wrists with a fabric wrap to protect their hands from impact, and support their wrists when striking an opponent or training bag. A typical prior art hand wrap includes a loop at the end, for hooking the end of the hand wrap around the user's thumb, and the hand wrap is then wrapped around the hand and wrist in a manner known in the art.

While the prior art hand wrap is easy to use, it sometimes does not provide adequate protection to the user's hand, especially around the knuckle area, which receives significant impacts during striking. It is therefore desirable to provide a hand wrap that offers further protection, while also providing a suitable anchor for the end of the hand wrap, so that the hand wrap may be wrapped in a suitable manner. The present invention fulfills these needs and provides further advantages as described in the following summary.

SUMMARY OF THE INVENTION

The present invention teaches certain benefits in construction and use which give rise to the objectives described below.

The present invention provides a hand wrap for wrapping a hand and a wrist of a user. The hand wrap includes a knuckle cover sheet having a first edge and a second edge and being shaped to fit over the hand of the user. The hand wrap also includes an elongate wrap body having a proximal end and a distal end, and is adapted to be wrapped around the hand and the wrist. An attachment strap connects the knuckle cover sheet with the proximal end of the elongate wrap body. A fastening mechanism fastens the distal end of the elongate wrap body to the elongate wrap body to secure the hand wrap in place around the hand and wrist of the user while in use.

A primary objective of the present invention is to provide a hand wrap having advantages not taught by the prior art.

Another objective is to provide a hand wrap that provides additional protection to the users hand and/or wrist.

Another objective is to provide a hand wrap with finger loops to facilitate the proper placement of the hand wrap upon the user.

A further objective is to provide a hand wrap that may be used with prior art hand wraps to increase the overall protection to the users hand and/or wrist.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a hand wrap for protecting a user's hand and wrist during martial arts or other sports or activities involving striking inanimate objects or persons with the hand.

Figure 1:
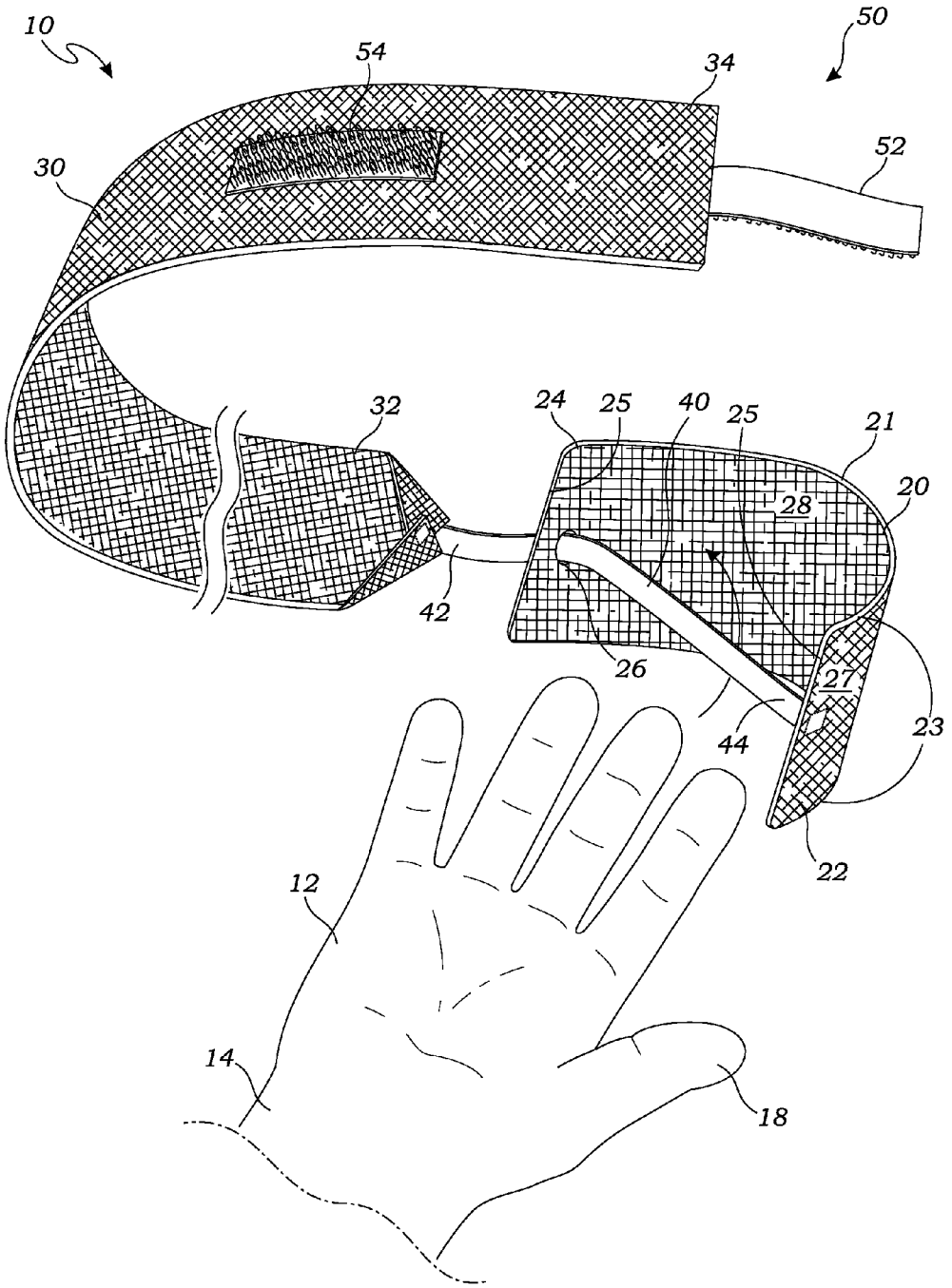
FIG. 1 is a perspective view of a first embodiment of a hand wrap of the present invention.

FIG. 1 is a perspective view of a first embodiment of a hand wrap 10 of the present invention. The hand wrap 10 is adapted for wrapping a user's hand 12 and a wrist 14 of a user. As illustrated in FIG. 1, the hand wrap 10 includes a knuckle cover sheet 20, an elongate wrap body 30, an attachment strap 40, and a fastening mechanism 50.

The knuckle cover sheet 20 is shaped to fit over and around a knuckle region 16 of the user's hand 12, providing both hand protection as well as an anchor for wrapping the hand wrap 10 around the user's hand 12 and wrist 14. The knuckle cover sheet 20 has a padded body 21 bounded by opposed lateral edges 23 and opposed side edges 25 that form a generally rectangular construction. The knuckle cover sheet 20 has an inner surface 28 and an opposed outer surface 27. The material of the knuckle cover sheet 20 may be any flexible material suitable for covering the user's hand 12, including but not limited to cloth, neoprene, leather, rubber, any form of padded material, and/or any other flexible material or combination suitable for providing hand protection.

The elongate wrap body 30 is a strip of flexible material designed to wrap one or more times around the user's hand 12 and/or wrist 14 to provide additional protection when striking persons or inanimate objects. The elongate wrap body 30 has a proximal end 32 and a distal end 34. The material of the elongate wrap body 30 may be composed of cloth, neoprene, leather, rubber, any form of padded material, and/or any other flexible material or combination suitable for providing hand protection and wrist support.

The attachment strap 40 is a flexible strip connecting the knuckle cover sheet 20 with the proximal end 32 of the elongate wrap body 30. In the embodiment of FIG. 1, a first end 42 of the attachment strap 40 is connected to the proximal end 32 of the elongate wrap body 30. In this embodiment, the opposed lateral edges 23 of the knuckle cover sheet 20 include a first edge 22 and a second edge 24. In this embodiment, an aperture 26 is formed in the knuckle cover sheet 20 proximate to the second edge 24, and a second end 44 of the attachment strap 40 is threaded through the aperture 26 and connected to the inner surface 28 near or adjacent the first edge 22. The method of attachment may include, but is not limited to, sewing, stitching, gluing, pinning or tying, and/or removably attaching with an fastener such as a button, hook, or any other fastener known in the art.

The fastening mechanism 50 is used for fastening the distal end 34 of the elongate wrap body 30 to the elongate wrap body 30 to secure the hand wrap 10 in place around the user's hand 12 and wrist 14 of the user while in use. The fastening mechanism 50 may include a first fastener 52, attached to the distal end 34 of the elongate wrap body 30, and a second fastener 54, attached to the elongate wrap body 30 near the distal end 34. The first fastener 52 and the second fastener 52 may be mating hooks and loops fasteners such as VELCRO®. The second fastener 54 is positioned such that it can be fastened to the first fastener 52 after the final wrapping of the elongate wrap body 30 around the users wrist 14.

Figure 2:
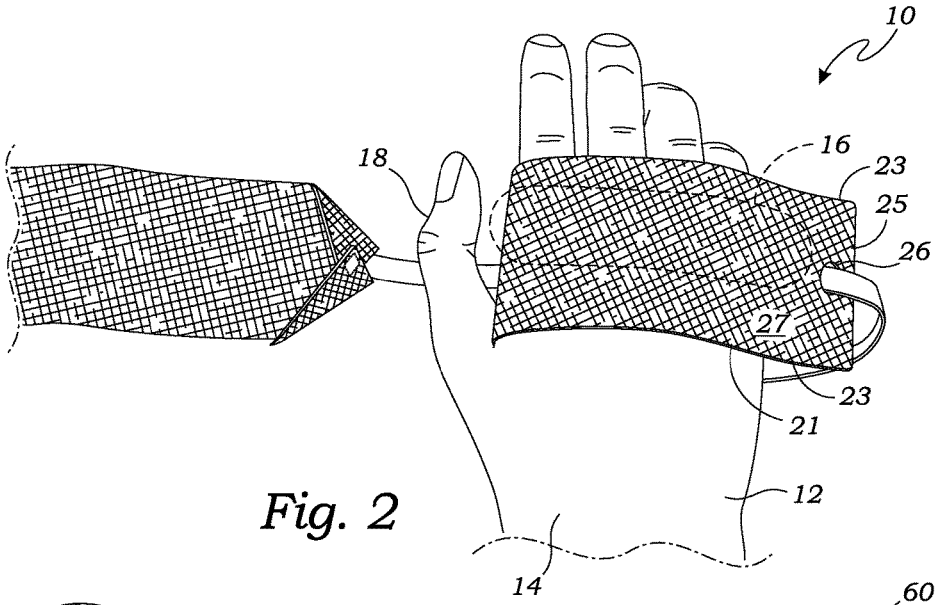
FIG. 2 is a perspective view of the hand wrap being wrapped around a hand of a user.

FIG. 2 is a perspective view of the hand wrap 10 being wrapped around the user's hand 12. As shown in FIG. 2, the user's hand 12, excepting the thumb 18, is placed within the space between the knuckle cover sheet 20 and the attachment strap 40, such that the padded body 21 traverses and substantially covers the knuckle region 16 without going around the thumb 18. The inner surface 28 (shown in FIG. 1) of the knuckle cover sheet 20 is in direct contact with of the knuckle region 16. The attachment strap 40 may be in contact with the user's palm or fingers before threading through the aperture 26 in the knuckle cover sheet 20. The elongate wrap body 30 is then wrapped around the user's hand 12 and wrist 14, over the knuckle cover sheet 20, using methods known to those skilled in the art. The wrapping motion is repeated until the length of the attachment strap 40 and elongate wrap body 30 have been used, at which time the user fastens the first fastener 52 to the second fastener 54 on the elongate wrap body 30.

Figure 3:
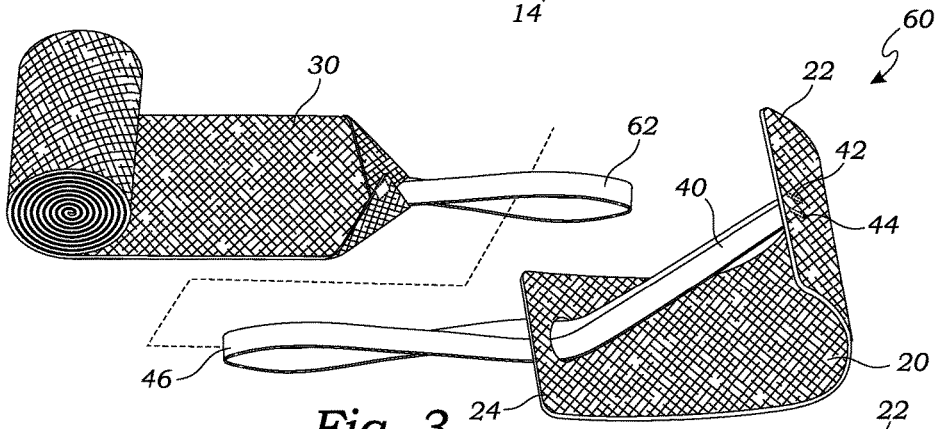
FIG. 3 is an exploded perspective view of a second embodiment of the hand wrap that is adapted for use with a prior art wrap.
Figure 4:
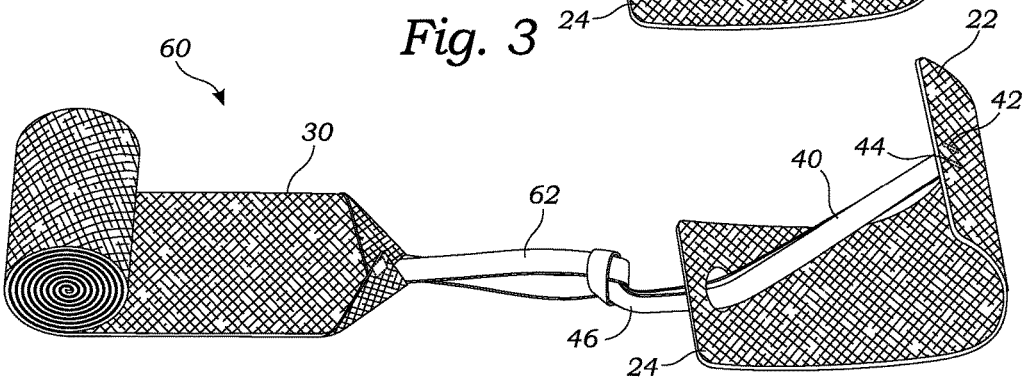
FIG. 4 is a perspective view of the hand wrap of FIG. 3 once it has been attached to the prior art wrap.

FIG. 3 is an exploded perspective view of a second embodiment of the hand wrap 60. FIG. 4 is a perspective view of the hand wrap 60 of FIG. 3 once it has been attached to the elongate wrap body 30. As illustrated in FIGS. 3-4, in this embodiment the knuckle cover sheet 20 is adapted for use with an embodiment of the elongate wrap body 30 that is of similar construction to prior art hand wraps. The elongate wrap body 30 of this embodiment includes a wrap loop 62 that is typically looped around the user's thumb 18. In this embodiment, the attachment strap 40 includes a looped end 46 that is attached to the wrap loop 62, in this embodiment via a slip knot, although alternative attachment methods may be utilized. In this embodiment, the looped end 46 is formed by attaching the first end 42 and second end 44 to the first edge 22 of the knuckle cover sheet 20; however, the loop may be formed in any manner known to those skilled in the art.

Figure 5:
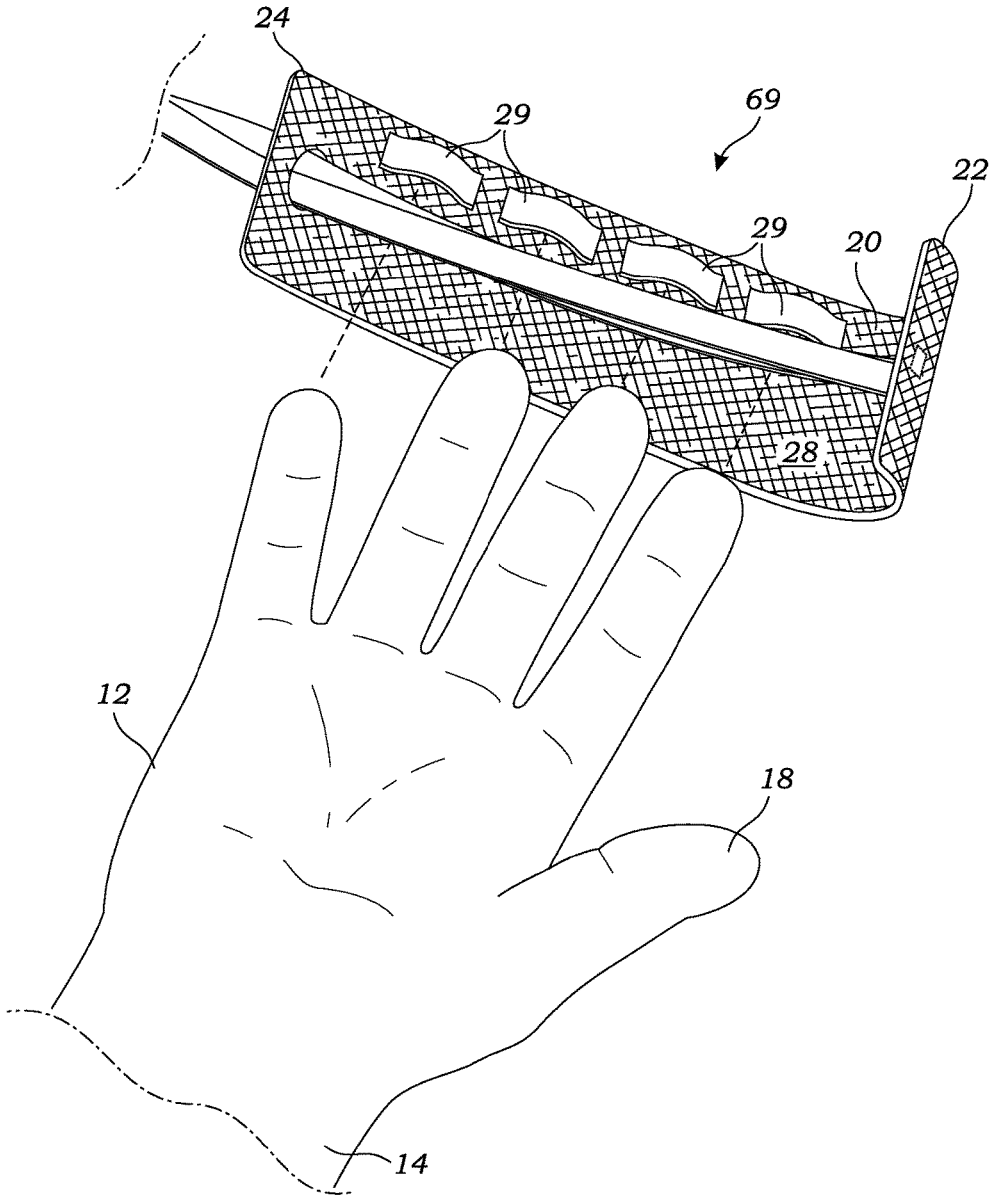
FIG. 5 is a perspective view of a third embodiment of the hand wrap that includes finger loops for holding the hand wrap on the hand of the user in a proper position.

FIG. 5 is a perspective view of a third embodiment of the hand wrap 69, wherein the hand wrap 69 includes finger loops 29 for holding the knuckle cover sheet 20 on the user's hand 12 in a proper position. The finger loops 29 are operatively positioned on the inner surface 28 of the knuckle cover sheet 20. The finger loops 29 may be sewn, glued or otherwise attached to the inner surface 28 of the knuckle cover sheet 20. This embodiment, while aiding in the proper placement of the knuckle cover sheet 20 on the users hand, also serves to restrict the movement of the knuckle cover sheet 20, in particular eliminating any chance of rotational motion around the axis extending from the users wrist 14 towards the hand. This adds utility to the hand wrap 10 because the ability to freely rotate has the potential to cause unwinding or bunching of the hand wrap 10. A further benefit of this embodiment is to prevent slippage of the hand wrap 10 up the users hand towards the wrist 14. The knuckle cover sheet 20 placement between the fingers and the thumb also prevents this sort of slippage, however the potential for bunching still exists. The finger loops 29 in this embodiment reduce that potential for bunching in the axial direction. Importantly, neither the knuckle cover sheet 20 nor the finger loops 29 extend around the thumb 18, as noted above.

Figure 6:
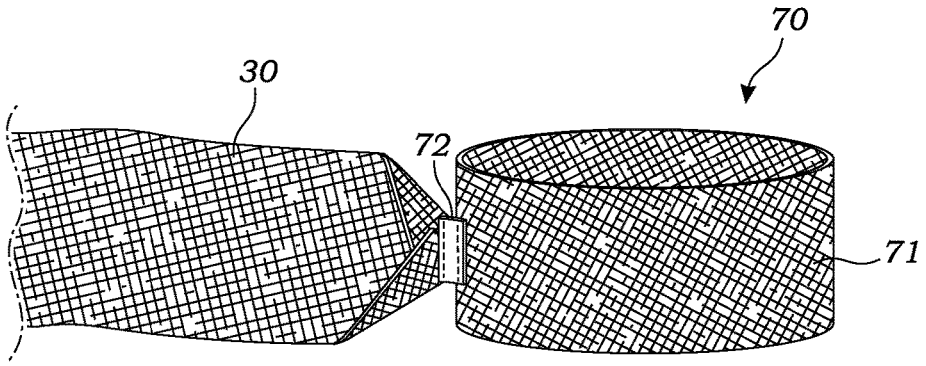
FIG. 6 is a perspective view of a fourth embodiment of the hand wrap where the hand wrap is a contiguous band sewn to the prior art wrap.

FIG. 6 is a perspective view of a fourth embodiment of the hand wrap 70. In this embodiment, a contiguous band 71 of material covers the knuckles of the user. In this embodiment, the contiguous band 71 is made of cloth which may be terry cloth, nylon, polyester or other materials common to those skilled in the art in the manufacture, although any suitably flexible and protective materials, comfortable to the user and suitable to the purposes of this invention, may be used. The elastic properties of the contiguous band 71 serve to restrain the contiguous band 71 from slippage around the user's hand during wrapping or use.

The contiguous band 71 may be sewn to the elongate wrap body 30 in any manner, either directly or indirectly. In this embodiment, the contiguous band 71 is connected at a connection point 72 to a elongate wrap body 30 by sewing or other equivalent method of attachment.

In use the contiguous band 71 is positioned around the knuckle region 16, without extending around the thumb 18 (shown in FIG. 2). The elongate wrap body 30 may then be wrapped around the hand and wrist, over the contiguous band 71, as described above.

Figure 7:
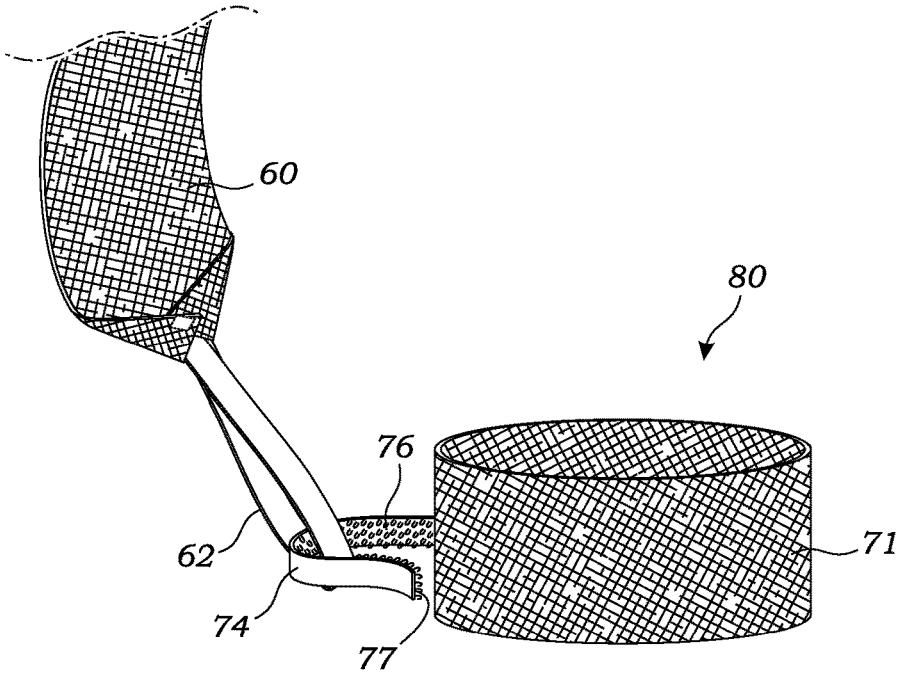
FIG. 7 is a perspective view of a fifth embodiment of the hand wrap where the hand wrap is contiguous band for attachment to a prior art hand wrap.

FIG. 7 is a perspective view of a fifth embodiment of the hand wrap 80 wherein the contiguous band 71 includes a connector strap 74 for attachment to the loop 62 of the elongate wrap body 30, similar to the embodiment of FIGS. 3-4. The inclusion of the connector strap 74 allows detachable use with replacements of the elongate wrap body 30.

In the present embodiment, the connector strap 74 includes a hooks and loops connector, such as Velcro®, and is threaded through the loop 62. The connector strap 74 has a hooks side 76 and a loops side 77, and after threading the loop 62 on the elongate wrap body 30, the hooks side 76 is connected to the loops side 77 to secure the elongate wrap body 30 and contiguous band 71 together. The method of connection is not limited to applications using hooks and loops fasteners, but may also include snaps, buttons, or other means of equivalent attachment mechanisms.

Figure 8:
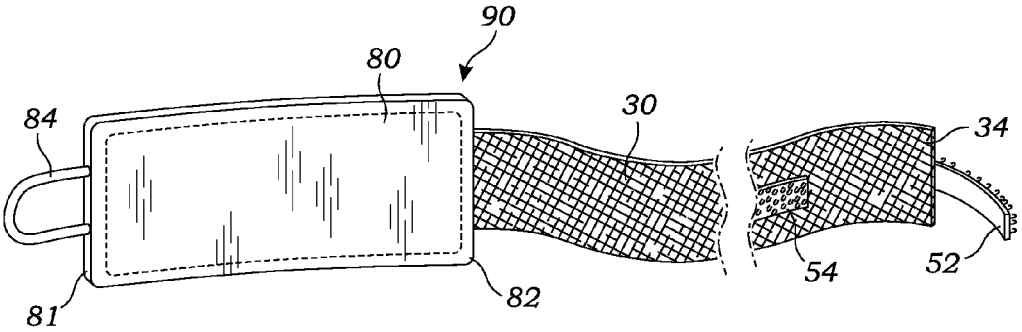
FIG. 8 is a perspective view of a sixth embodiment of the hand wrap where the area most directly in contact with a thenar is padded.

FIG. 8 is a perspective view of a sixth embodiment of the hand wrap 90. In this embodiment, an elongate pad 80 has a thumb end 81 and a wrap end 82. The elongate wrap body 30 is attached to the wrap end 82 of the elongate pad 80. A thumb loop 84 is attached to the thumb end 81 of the elongate pad 80. The elongate wrap body 30 has a first fastener 52, attached to the distal end 34 of the elongate wrap body 30, and a second fastener 54, attached to the elongate wrap body 30 near the distal end 34.

Figure 9:
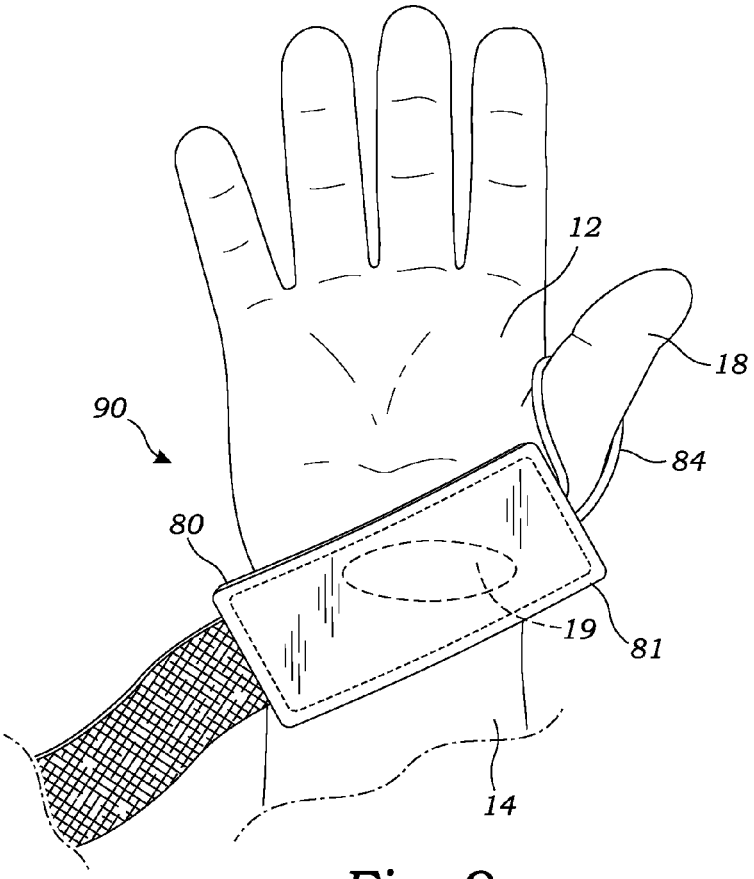
FIG. 9 is a perspective view of the sixth embodiment of the hand wrap in place over the hand of the user.

FIG. 9 is an illustration of the hand wrap 90 in place on the user's hand 12, with the elongate pad 80 properly positioned over the user's thenar 19 and the user's thumb 18 through the thumb loop 84. In use, the thumb loop 84 is positioned around the user's thumb 18 in a manner similar to prior art hand wraps. In this embodiment, the elongate pad 80 is positioned over a thenar 19 portion of the hand 12, adjacent a heel of the hand 12, to provide additional protection to the user's hand 12 in that vulnerable location. The elongate wrap body 30 is then wrapped around the user's hand 12 and wrist 14, and in particular the elongate pad 80, to secure the elongate pad 80 in place over the thenar 19.

Figure 10:
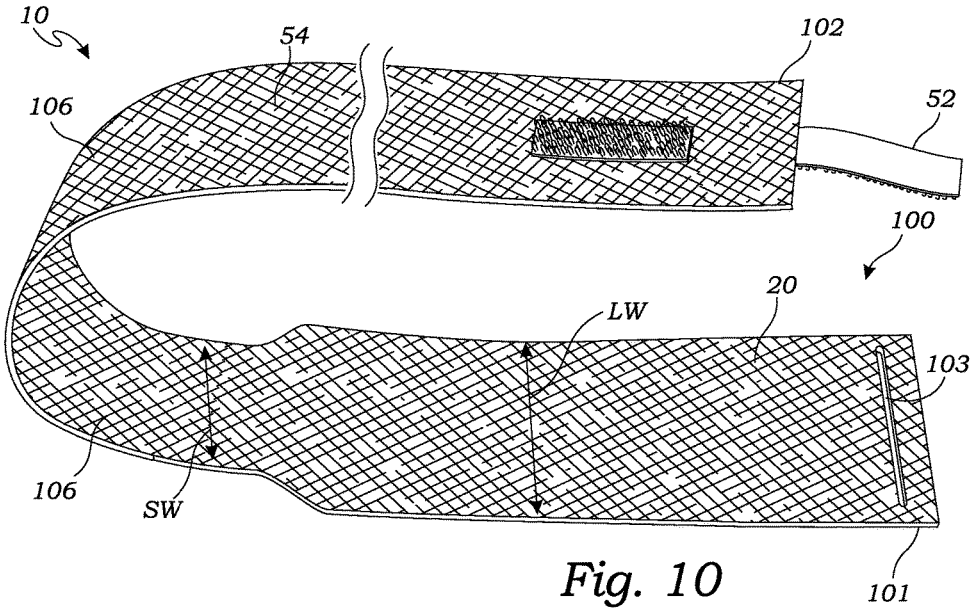
FIG. 10 is a perspective view of a seventh embodiment of the hand wrap where the hand wrap includes a slit for the purpose of making an adjustable loop used to secure the wrap on the hand of the user.
Figure 11:
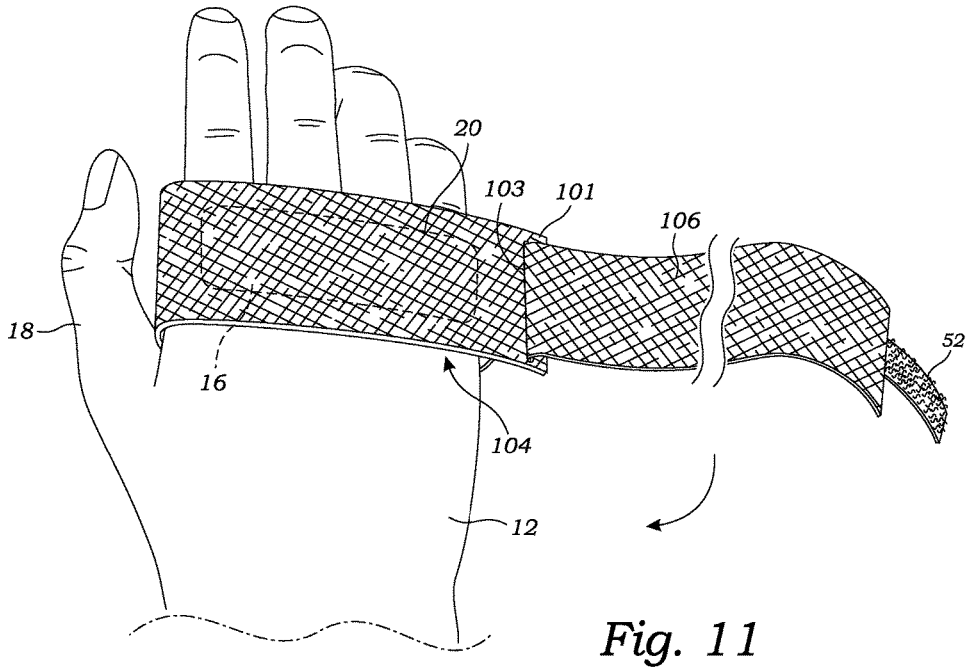
FIG. 11 is a perspective view of the seventh embodiment of the hand wrap in place over the hand of a user, illustrating how the loop is formed.

FIG. 10 is perspective view of another embodiment of the hand wrap 100 for wrapping the hand 12 of the user. FIG. 11 is a perspective view of the hand wrap 100 being wrapped on the hand 12 of the user. As shown in FIGS. 10 and 11, the hand wrap 100 has a proximal end 101 and a distal end 102. On the proximal end 101, a slit 103 is formed through the material of the hand wrap 100. The slit 103 is largely perpendicular to the length of the hand wrap 100 for threading the distal end 102 of the wrap through the slit, forming a loop 104 through which the user's hand 12 may be inserted. The loop 104 formed by threading the distal end 102 through the slit 103 is placed over the user's hand 12 such that the hand wrap 100 covers the knuckle region 16. The hand wrap 100 is then tightened by pulling on the distal end 102 and wrapping it around the user's hand 12 and wrist, as described in greater detail above.

In this embodiment, the knuckle cover sheet 20 is formed in the proximal end 101, and has a larger width LW that is greater than a body 106 of the hand wrap 100. The knuckle cover sheet 20 is positioned over the user's hand 12 and may be over a knuckle region 16 to protect the user's knuckles. The knuckle cover sheet 20 may be thicker, padded, or otherwise constructed to protect the knuckles of the user. The distal end 102 has a smaller width SW that is small enough to be inserted through the slit 103. The body 106 is then wrapped around the user's hand 12 and wrist 14. It may be first wrapped over the knuckle cover sheet 20, to secure it in place, and then continue around the wrist, to protect the hand 12 and support the wrist 14. The user then fastens the distal end 34 of the elongate wrap body 30 to the elongate wrap by connecting the first fastener 52 to the second fastener 52, as discussed above. This secures the hand wrap 10 in place around the hand 12 and the wrist 14 of the user.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A hand wrap adapted to be wrapped around a hand and a wrist of a user, the hand wrap comprising:

a knuckle cover sheet having opposed lateral edges and opposed side edges that form a rectangular construction, the side edges including a first edge and an opposing second edge that form the opposing sides of the rectangular construction and are adapted to fit over the hand of the user;

an elongate wrap body having an elongate rectangular construction that extends from a proximal end to a distal end, and is adapted to be wrapped around the hand and the wrist of the user;

wherein the knuckle cover sheet and the elongate wrap body are physically separate from each other and are only connected together by an attachment strap, wherein the attachment strap includes a first end sewn to the proximal end of the elongate wrap body, and the attachment strap extends through an aperture through the knuckle cover sheet, said aperture extending through the knuckle cover sheet adjacent the second edge of the knuckle cover sheet, to a second end which is sewn to the first edge of the knuckle cover sheet, such that the knuckle cover sheet and the attachment strap together form a loop that is adapted to be positioned around the user's hand for holding the knuckle cover sheet in position over the user's hand; and a fastening mechanism for fastening the distal end of the elongate wrap body to the elongate wrap body to secure the hand wrap in place around the hand and wrist of the user once the elongate wrap body has been wrapped around the user's hand and wrist, and over the knuckle cover sheet.

2. The hand wrap of claim 1, further comprising finger loops operatively positioned on an inner surface of the knuckle cover sheet.

3. The hand wrap of claim 1, wherein the fastening mechanism includes a first fastener that extends from the distal end of the elongate wrap body, and a second fastener positioned on the elongate wrap body.

4. The hand wrap of claim 3, wherein the first fastener and the second fastener are mating hooks and loops fasteners.

* * * * *